US006679577B2

(12) United States Patent
Du et al.

(10) Patent No.: US 6,679,577 B2
(45) Date of Patent: Jan. 20, 2004

(54) METHOD OF PERFORMING PRINTHEAD MAINTENANCE

(75) Inventors: Ben-Chuan Du, Shindian (TW); Yung-Yi Li, Yungkang (TW)

(73) Assignee: Benq Corporation, Taoyuan (TW)

( * ) Notice: Subject to any disclaimer, the term of this patent is extended or adjusted under 35 U.S.C. 154(b) by 0 days.

(21) Appl. No.: 10/068,874

(22) Filed: Feb. 11, 2002

(65) Prior Publication Data

US 2002/0149641 A1 Oct. 17, 2002

(30) Foreign Application Priority Data

Apr. 17, 2001 (TW) ..... 90109220 A

(51) Int. Cl.[7] ..... B41J 2/165

(52) U.S. Cl. ..... 347/23

(58) Field of Search ..... 347/23, 29, 30, 347/33, 14, 19, 35

(56) References Cited

U.S. PATENT DOCUMENTS 5,493,319 A * 2/1996 Hirabayashi et al.
6,494,560 B1 * 12/2002 Seshimo et al. ..... 347/23

* cited by examiner

*Primary Examiner*—Shih-Wen Hsieh
(74) *Attorney, Agent, or Firm*—Rabin & Berdo, P.C.

(57) ABSTRACT

A method of performing printhead maintenance comprises the steps as follow. First, the orifices of the printhead are defined to form a plurality of orifice groups. Then, a test graph comprising a plurality of test lines associated with the orifice groups is provided, and the ink is ejected through the printhead to obtain a printing result of the test graph. Next, the orifice groups containing the clogged orifices are selected according to the printing result. Then the orifice groups to be cleaned undergo the maintenance procedure. In the present invention, the orifice groups to be cleaned are determined by comparing the printing result and the test graph. Then the maintenance procedure can be selected to purge only the orifice groups containing clogged orifices, so that the unnecessary consumption of ink in purging unclogged orifices is reduced.

26 Claims, 4 Drawing Sheets

METHOD OF PERFORMING PRINTHEAD MAINTENANCE

This application incorporates by reference Taiwanese application Serial No. 90109220, filed Apr., 17, 2001.

BACKGROUND OF THE INVENTION

1. Field of the Invention

The invention relates in general to a method of performing printhead maintenance, and more particularly to a maintenance method for increasing the utility of ink used in various inkjet printing apparatus, such as the printer, facsimile machine, and multi-function peripheral (MFP).

2. Description of the Related Art

In the present age of high technology, the computer is a daily necessity for the modern person. Consequently, a variety of associated electronic products (such as scanners, printers, digital cameras, etc.) become highly desirable, the printer being the most popular product. The printer is used to print out the desired information, including documents and colored pictures. The pictures, usually downloaded from the Internet or photographed by the digital camera, are saved on the computer in digital forms and then printed out by the printers. For general printing purposes, the color inkjet printer is still the favorite for home use, considering the printing quality and price.

In the inkjet printer, the ink cartridge is driven right and left, and ink droplets are ejected from the cartridge chamber onto the receiving print material at the appropriate time, and thus the text or picture is formed. According to the liquid droplet ejection system, cartridges of commercially available inkjet printers are generally classified into two types—bubble (thermal) jet cartridge and piezoelectric cartridge. In present day usage, ink ejection by a thermally driven bubble is the most successful and common, due to its relative simplicity, image quality, and low cost. The bubble jet cartridge mainly comprises heaters, ink, and orifices. The heater activates the ink and generates bubbles, and then the ink is pressurized by the expanding bubbles and ejected through each orifice to print a dot of ink onto a recording medium, such as a sheet of paper. It is critical to control the concentration of ink and the falling location of each droplet during printing, wherein numerous dots of ink combine to form the desired letters or pictures.

However, in some situations, the ink is not ejected smoothly from the orifices, resulting in reduced printing quality. There are several causes of poor-quality ejection. For example, when the ink cartridge is just replaced, the original ink remaining in the orifices may have deteriorated due to a prolonged quiescent period or time-consuming replacement period. Also, ink components accumulated in the orifices could block the flow of ink after operating several printing cycles. In addition, the inkjet printer is typically maintained in the stand-by or quiescent mode, which can stretch over a relatively long interval, sometimes on the order of minutes or even hours. During these quiescent intervals, the ink is allowed to stand and thicken due to evaporation of ink components, and the ink could possibly accumulate in the orifices of the printhead. If the printing effect of an inkjet printer is in doubt, the printer can be commanded to run a print test and print out a predetermined test graph. According to the result of printing the test graph, it can be determined if the maintenance function is required for cleaning the printhead.

In commercially available inkjet printers, the maintenance function is commonly accomplished by brushing, wiping, spraying, vacuum suction, or spitting of ink through the orifice. However, when conventional inkjet printers perform the spitting maintenance, the user does not know which orifices are clogged since the ink is ejected through all orifices, clogged or not. The circuit of the printhead can be controlled to purge only the clogged orifices, so in the conventional maintenance method, the extra ink ejected through the unclogged orifices goes to waste. Details of a conventional maintenance procedure are illustrated below, with reference to FIGS. 1A, 1B, and 2.

FIG. 1A depicts a predetermined test graph of a conventional inkjet printer. An ink cartridge containing four primary colors is taken for illustration. The predetermined test graph 100 is composed of a yellow (Y) test region 110, a magenta (M) test region 120, a cyan (C) test region 130, and a black (K) test region 140. Each test region contains a number of discontinuous linear sections, as shown in FIG. 1A. If none of the orifices is clogged, the printing result of printing the test graph will be identical with the predetermined test graph 100 of FIG. 1A, wherein every single section in the test region is clearly and completely printed.

FIG. 1B illustrates a bad result of printing the test graph of FIG. 1A. Since many orifices of the printhead are clogged, the lines associated with the clogged orifices are not fully represented in the printing result. Thus the printing result 100' is an incomplete representation of the predetermined test graph 100. According to the foregoing description, the conventional method of determining if the orifices are clogged is to obtain a printing result of the predetermined test graph and examine the result with the naked eye. If the orifices are judged to be clogged, then the printhead receives a maintenance procedure for purging the clogged orifices, upon the user's request.

FIG. 2 shows a flow chart of a conventional method of performing printhead maintenance. When the orifices seem to be clogged, the user gives a maintenance order to the printer to print out the predetermined test graph (step 204). Then the printing result is obtained and examined to determine whether the orifices are blocked or not (step 206). If the determination is negative (no-clog situation), the orifice inspection is terminated. If the determination is positive (clogged situation), the operation is led to step 208 and all printhead orifices are requested to eject ink continuously. Then steps 204 and 206 are repeated. The maintenance loop of FIG. 2 can be performed repeatedly until all orifices are completely unclogged.

According to the aforementioned illustration, the conventional method of performing printhead maintenance is to make every orifice eject ink continuously so as to purge the clogged orifices. However, this maintenance method does not distinguish between clogged and not clogged orifices, and thus, ink is wastefully consumed in unnecessarily purging the unclogged orifices. The more ink the printhead ejects unnecessarily, the more ink and money the user wastes.

SUMMARY OF THE INVENTION

It is therefore an object of the invention to provide a method of performing printhead maintenance, wherein only the orifice group containing clogged orifices is treated by the cleaning action, so that unnecessary consumption of ink is greatly reduced.

According to the objective of the invention, a method of performing printhead maintenance is provided, and comprises the following steps. First, all orifices of the printhead are grouped to form a plurality of orifice groups. Then, a test graph is constructed based on the orifice groups, in order to determine if the orifice groups need to be cleaned. During the construction of the test graph, each test line or curve of the test graph is specifically associated with an orifice group. Therefore, the orifice group containing clogged orifices is revealed after examining the test lines or curves in the printing result of the test graph. If the orifices seem to be clogged, a print test order is sent to the inkjet printer for printing out the test graph. After the printing result is obtained, it is examined with the unaided (naked) eye or with a sensor to see if the printing result completely and clearly represents all orifice groups, and to determine whether the orifices are blocked or not. If the test curves of the printing result are not complete, the orifice groups to be cleaned are selected and a cleaning action, such as ejecting ink through the orifices or wiping the orifices, is run. The maintenance loop can be performed repeatedly until all of the orifices are completely cleaned.

BRIEF DESCRIPTION OF THE DRAWINGS

Other objects, features, and advantages of the invention will become apparent from the following detailed description of the preferred but non-limiting embodiment. The description is made with reference to the accompanying drawings in which.

DESCRIPTION OF THE PREFERRED EMBODIMENT

In the present invention, a method of performing printhead maintenance applicable to an inkjet printer is disclosed. An inkjet printer contains a carriage for carrying an inkjet printhead, and the carriage is driven back and forth by a motor, along a set path. The inkjet printhead comprises a number of orifices for ejecting ink. If some orifices are blocked, then the ink will not be eject properly through the orifices, and maintenance on the printhead is requested. The conventional maintenance method consumes more ink than needed by pressurizing ink through all orifices, clogged or not. The ink ejected through the unclogged orifices, for maintenance purposes, can be wasteful and should be saved. Accordingly, a more economical approach is disclosed herein. First, the orifices of the printhead are grouped, and then the groups containing clogged orifices are determined by examining the printing result. Only the group(s) containing clogged orifices will receive the maintenance procedure, and the amount of ink consumed is consequently reduced.

Figure 1A:
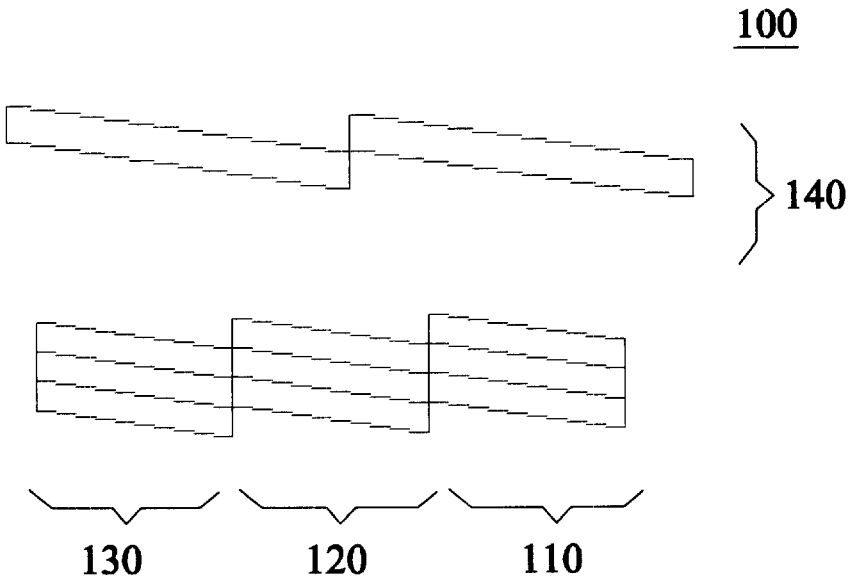
FIG. 1A (PRIOR ART)
FIG. 1A (prior art) depicts a predetermined test graph of conventional inkjet printer.
Figure 1B:
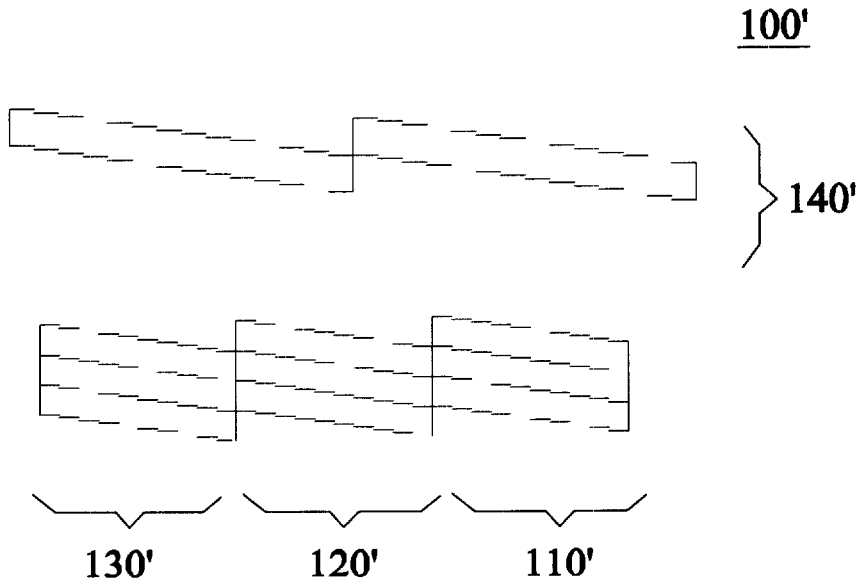
FIG. 1B (PRIOR ART)
FIG. 1B (prior art) is a bad printing result of the test graph of FIG. 1A.
Figure 2:
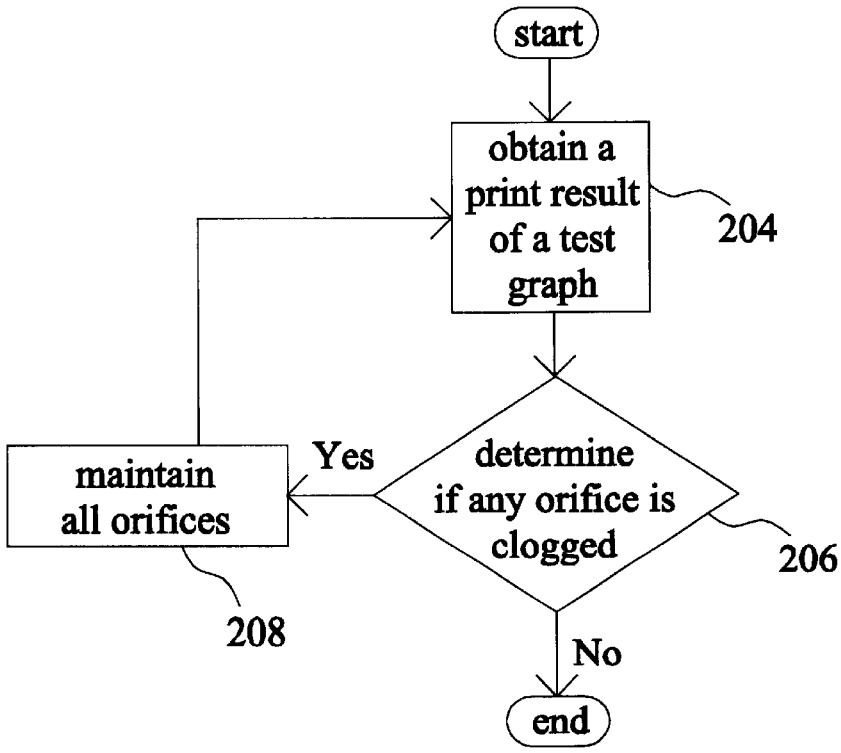
FIG. 2 (PRIOR ART)
FIG. 2 (prior art) is a flow chart of a conventional method of performing printhead maintenance.
Figure 3:
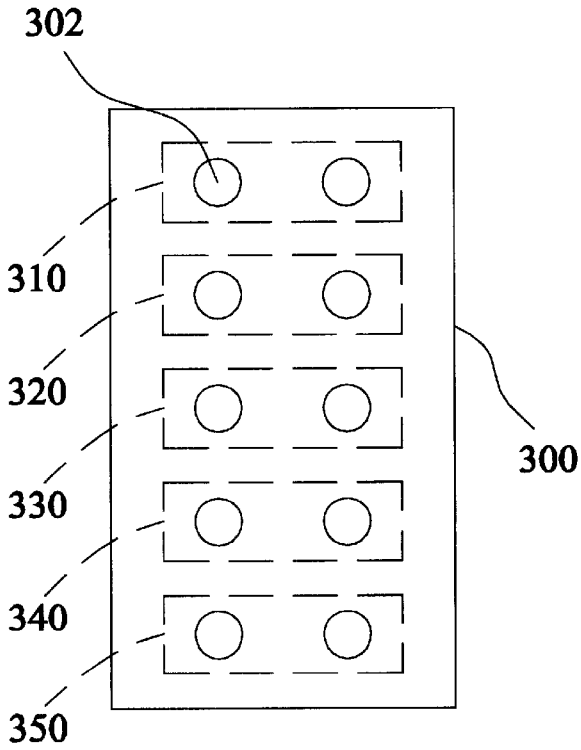
FIG. 3 shows a grouping of orifices on the printhead according to an embodiment of the invention.

Referring to FIG. 3, it shows a grouping of orifices on the printhead according to an embodiment of the invention. To simplify the illustration, it is assumed that the printhead 300 contains only 10 orifices 302, linearly arranged in two parallel columns. In FIG. 3, two orifices 302 adjacently aligned are grouped together so that 10 orifices 302 are defined to be 5 orifice groups, including orifice groups 310, 320, 330, 340, and 350.

Figure 4:
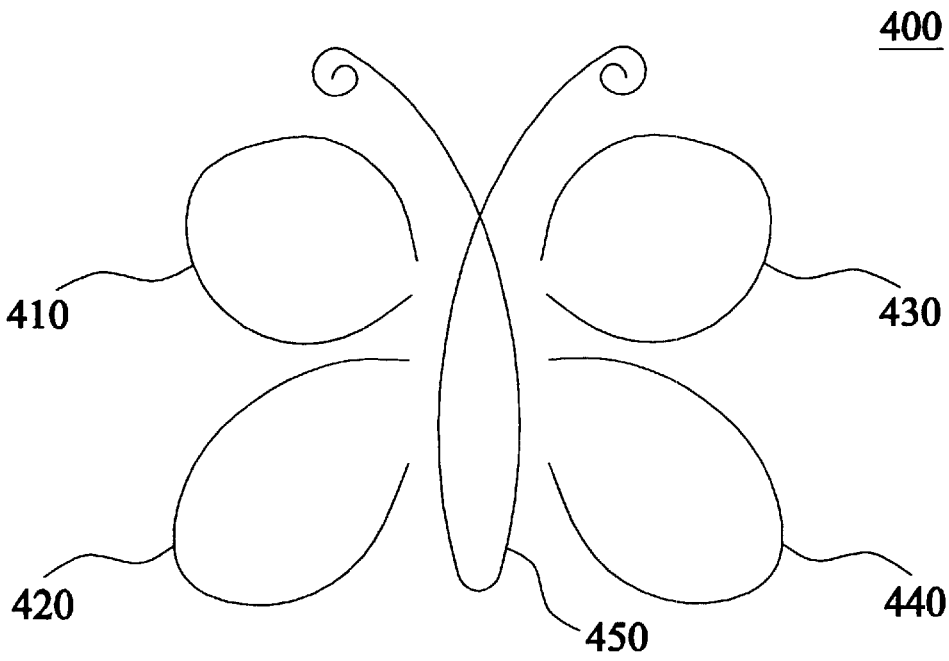
FIG. 4 shows a test graph associated with the orifice groups of FIG. 3.

FIG. 4 shows a test graph associated with the orifice groups of FIG. 3. Five test curves compose the butterfly-like test graph 400 in FIG. 4, and each test curve is associated with an orifice group of FIG. 3. For instance, the test curve 410 is formed by the ejection of ink droplets from orifice group 310. Similarly, the test curves 420, 430, 440, and 450 are formed by the ejection of ink droplets from orifice groups 320, 330, 340, and 350, respectively.

Subsequently, ink within the vaporization chambers is ejected through the orifice groups to form a printing result of test graph 400. The printing result is then compared with the test graph 400 to determine if the curves of printing result are complete. Thus, the orifice group(s), containing the clogged orifices, is (are) indicated. The comparison between the printing result and original test graph can be done with the naked eye or with a sensor. After the orifice group having the clogged orifices is selected, a maintenance procedure, such as heating, ejection of ink, wiping orifices (with wiper blades), or a combination thereof, is performed on the orifices to be purged. It will be appreciated by those skilled in the art that the figure of the test graph is not limited to the butterfly-like image.

Figure 5:
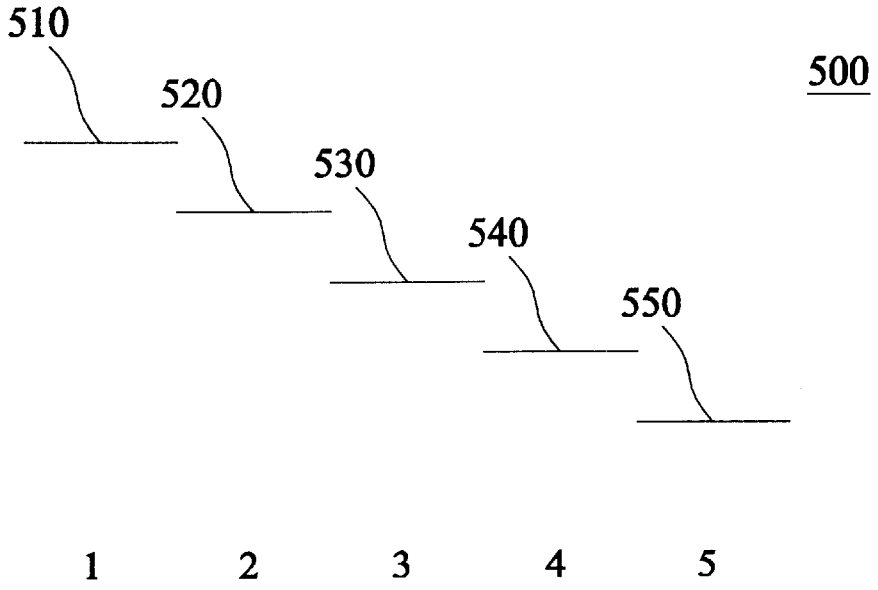
FIG. 5 shows another test graph associated with the orifice groups of FIG. 3.

FIG. 5 shows another test graph associated with the orifice groups of FIG. 3. The test graph 500 in FIG. 5 includes test lines and numbers. The numbers under the test lines represent the corresponding orifice groups on the inkjet printhead, wherein the orifice groups are also numbered corresponding to the numbers in test graph 500. For example, the orifice groups 310 to 350 on the inkjet printhead are numbered 1 to 5. The test line 5 and number "1" in FIG. 5 are formed by the ejection of ink droplets from the first orifice group (orifice group 310). In other words, using the numbers in the test graph can clearly indicate the associated orifice groups. Similarly, the formation of the test line 520 and number "2" correspond to the second orifice group (orifice group 320); the formation of the test line 530 and number "3" correspond to the third orifice group (orifice group 330); and so on.

If the orifice groups on the printhead are not clogged, the printing result of the test graph 400 or 500 is identical with the corresponding original test graph in FIG. 4 or FIG. 5, and each test curve (line) and number are clearly printed. If a portion of orifices is clogged, the associated test curves and numbers will appear discontinuous or faint, so that the printing result 400 or 500 incompletely represents the test graph. Consequently, orifice groups containing clogged orifices can be selected for maintenance according to the printing result. Moreover, the test graph 400, unlike the test graph 500, includes only the test curves so that the printing result must be compared with the original test graph 400 of FIG. 4 to determine which orifice groups contain blocked orifices. In contrast, the test graph 500 of FIG. 5 includes numbers associated with the orifice groups for determining which orifice group needs to be cleaned, and thus no comparison is needed. Because the comparison step is omitted, test graph 500 offers more convenience for the user than test graph 400 of FIG. 4 offers.

Additionally, the printhead includes a nozzle member comprising hundreds of orifices. If the orifices are finely grouped, such as 2 to 10 orifices in a group, many orifice groups will be defined. For example, dozens of orifice groups could be defined, and if a test line corresponds to an orifice group, the test graph will include dozens of test curves (lines). Then, it is not an easy task to compare the printing result with the test graph. Accordingly, the test graph 500 of FIG. 5 can be further simplified by eliminating the test lines. The numbers in the printing result directly point out which orifice groups need to be cleaned. For example, a number "3" represents that the third orifice group contains orifices that require maintenance. Consequently, ink is activated and ejected through the orifices of the third group for dispelling the clogging situation. This design of test graph offers the user a convenient and timesaving method for determining and selecting which orifice groups to receive the maintenance routine.

It is noted that the method of grouping orifices is not limited hereto. For example, the total number of orifices in a group is not restricted to the examples in the demonstration of the preferred embodiment. Also, the test graph is not restricted to only test curves or lines; it can comprise test curves, regions, or blocks, or a combination thereof. The critical point of the invention is that the components of test graph (line, curve, region, etc.) are associated with the orifice groups in order to reveal which groups contain clogged orifices, so that the number of orifices to be cleaned is narrowed down.

Figure 6:
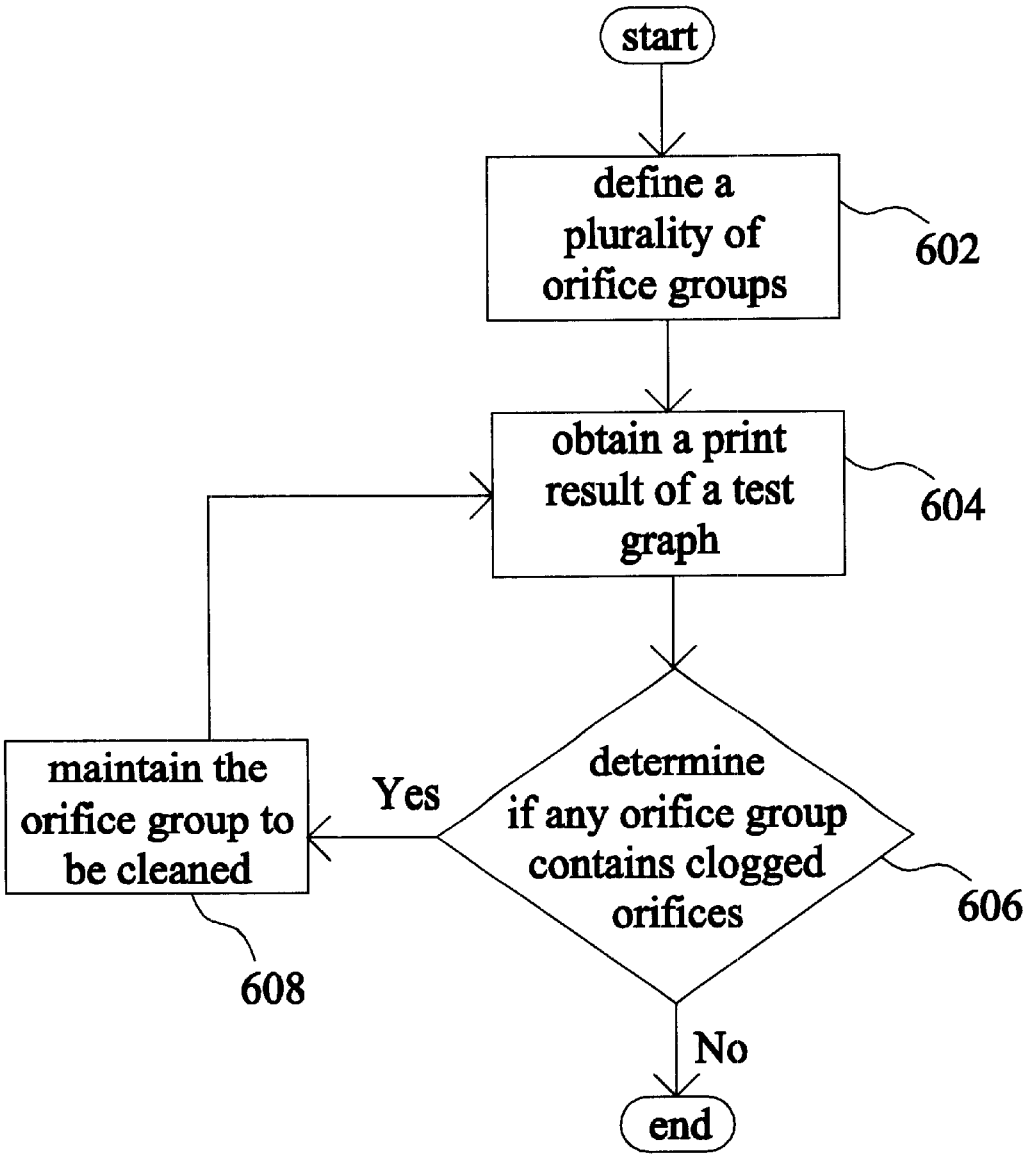
FIG. 6 is a flow chart of the method of performing printhead maintenance according to the preferred embodiment of the invention.

FIG. 6 is a flow chart of the method of performing printhead maintenance according to the preferred embodiment of the invention. First, all orifices of the printhead are classified, and a plurality of orifice groups are defined (step 602). When the orifices seem to be clogged, a maintenance order is given to the printer for printing out a predetermined test graph (step 604). After the printing result is obtained, it is examined with the unaided (naked) eye or a sensor to determine whether the orifices are blocked or not (step 606). If the determination is negative (no-clog situation), the orifice inspection is terminated. If the determination is positive (clogged situation), the operation is led to step 608 and only the orifice groups to be cleaned are requested to continuously eject ink. Then the operation is led to steps 204 and 206 again. The maintenance loop of FIG. 6 can be performed repeatedly until all offices are completely cleaned.

Furthermore, the other orifice groups including unclogged orifices could be kept at rest or could also receive routine maintenance, such as heating the orifices, ejecting ink from the orifices, wiping the orifices (with wiper blades), surface adsorption of the orifices, or a combination thereof. If ejection of ink is chosen as the maintenance regime for all orifices, the object of economical ink consumption can be achieved by ejecting different amounts of ink. For instance, the amount of ink ejected through the clogged orifice groups can be more than the amount ejected through unclogged orifice groups. The different amounts of ink ejection can be controlled by adjusting the heating frequencies, ink ejection frequencies, electrical pulse for driving the heaters, or duration of ink ejection.

In this disclosed embodiment, the method of performing printhead maintenance applied in the inkjet printer is taken for illustration. However, the invention is not limited herein. The method of performing printhead maintenance according to the invention is applicable to other apparatus for printing images, such as the fax machine and multi-function peripheral (MFP).

According to the aforementioned description, the method of the invention first groups all the orifices of printhead, and then selects the orifice groups to be cleaned by comparing the predetermined test graph and the printing result. The orifice groups containing clogged orifices are purged by the ejection of ink while the other orifice groups do not need to be purged. Consequently, unnecessary ink consumption is avoided, thus increasing the utility of the ink cartridge and the user's expense.

While the invention has been described by way of examples and in terms of the preferred embodiment, it is to be understood that the invention is not limited to the disclosed embodiment herein. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A method of performing printhead maintenance, applied in an image-printing apparatus for cleaning a printhead carried by a cartridge, wherein the printhead contains a plurality of orifices, the method comprising steps of:

defining the orifices to form a plurality of orifice groups including a first and a second orifice group;

providing a test graph which comprises a first and a second curve, associated respectively with the first and the second orifice group, wherein the first and the second curve have different curvatures;

obtaining a printing result of the test graph by ejecting ink from the orifices of the printhead;

selecting an orifice group to be cleaned according to the printing result of the first and the second curve; and giving a maintenance order to perform a cleaning action on the selected orifice group to be cleaned.

2. The method of performing printhead maintenance according to claim 1, wherein the orifice group to be cleaned is selected by the observation of the naked eyes.

3. The method of performing printhead maintenance according to claim 1, wherein the orifice group to be cleaned is selected by the detection of a sensor.

4. The method of performing printhead maintenance according to claim 1, wherein the cleaning action is heating the orifice group to be cleaned.

5. The method of performing printhead maintenance according to claim 1, wherein the cleaning action is ejecting ink from the orifice group to be cleaned.

6. The method of performing printhead maintenance according to claim 1, wherein the cleaning action is wiping the orifice group to be cleaned.

7. The method of performing printhead maintenance according to claim 1, wherein the first curve is curved as "1" representing the first orifice group, and the second curve is curved as "2" representing the second orifice group.

8. The method of performing printhead maintenance according to claim 1, wherein the first curve and the second curve are distinguishably identifiable so that the test graph is easy to make comparison by a human eye.

9. The method of performing printhead maintenance according to claim 8, wherein the test graph is a butterfly-like test graph.

10. The method of performing printhead maintenance according to claim 1, wherein the first curve includes a first symbol corresponding to the first orifice group and the second curve includes a second symbol, different from the first symbol, corresponding to the second orifice group.

11. The method of performing printhead maintenance according to claim 10, wherein the first symbol is a first numeral and the second symbol is a second numeral.

12. A method of performing printhead maintenance, applied in an image-printing apparatus for cleaning a printhead carried by a cartridge, wherein the printhead contains a plurality of orifices, the method comprising steps of:

defining the orifices to form a plurality of orifice groups;

providing a test graph which comprises a plurality of test lines associated with the orifice groups;

obtaining a printing result of the test graph by ejecting ink from the orifices of the printhead;

determining the printing result to include an incomplete printing of at least one of the test lines;

selecting at least one of the orifice groups to be cleaned according to the printing result, wherein said at least one of the orifice groups is associated with the at least one of the test lines determined to be incompletely printed; and giving an order to perform a first cleaning action on said at least one of orifice groups, and giving another order to perform a second cleaning action on at least one remaining orifice group among the orifice groups, wherein the first cleaning action differs from the second cleaning action so that economical ink consumption is achieved.

13. The method of performing printhead maintenance according to claim 12, wherein at least one orifice group ejects ink in order to obtain the printing result of the test graph.

14. The method of performing printhead maintenance according to claim 12, wherein the first cleaning action is selected from a group consisting of heating, ejecting, surface wiping, and surface adsorption.

15. The method of performing printhead maintenance according to claim 12, wherein the second cleaning action is selected from a group consisting of heating, ink ejection, surface wipe, surface adsorption, and quiescence.

16. The method of performing printhead maintenance according to claim 15, wherein heating frequency of the first cleaning action is different from that of the second cleaning action.

17. The method of performing printhead maintenance according to claim 15, wherein ink-ejecting frequency of the first cleaning action is different from that of the second cleaning action.

18. The method of performing printhead maintenance according to claim 15, wherein electrical pulse for driving ink ejection of the first cleaning action is different from that of the second cleaning action.

19. The method of performing printhead maintenance according to claim 15, wherein duration of ink ejection of the first cleaning action is different from that of the second cleaning action.

20. The method of performing printhead maintenance according to claim 12, wherein the image-printing apparatus is an inkjet printer.

21. The method of performing printhead maintenance according to claim 12, wherein the image-printing apparatus is a fax machine.

22. The method of performing printhead maintenance according to claim 12, wherein the image-printing apparatus is a multi-function peripheral (MFP).

23. A method of performing printhead maintenance, applied in an image-printing apparatus for cleaning a printhead carried by a cartridge, wherein the printhead contains a plurality of orifices, the method comprising steps of:

defining the orifices to form a plurality of orifice groups;

providing a test graph, which comprises a plurality of test lines associated with the orifice groups;

obtaining a printing result of the test graph by ejecting ink from the orifices of the printhead;

selecting at least one of the orifice groups to be cleaned according to the printing result; and giving an order to perform a first cleaning action on said at least one of the orifice groups to be cleaned, and another order to perform a second cleaning action on the other orifice groups;

wherein the first cleaning action is selected from a group consisting of heating, ejecting, surface wiping, and surface adsorption, and heating frequency of the first cleaning action is different from that of the second cleaning action.

24. A method of performing printhead maintenance, applied in an image-printing apparatus for cleaning a printhead carried by a cartridge, wherein the printhead contains a plurality of orifices, the method comprising steps of:

defining the orifices to form a plurality of orifice groups;

providing a test graph, which comprises a plurality of test lines associated with the orifice groups;

obtaining a printing result of the test graph by ejecting ink from the orifices of the printhead;

selecting at least one of the orifice groups to be cleaned according to the printing result; and giving an order to perform a first cleaning action on said at least one of the orifice groups to be cleaned, and another order to perform a second cleaning action on the other orifice groups;

wherein the first cleaning action is selected from a group consisting of heating, ejecting, surface wiping, and surface adsorption, and ink-ejecting frequency of the first cleaning action is different from that of the second cleaning action.

25. A method of performing printhead maintenance, applied in an image-printing apparatus for cleaning a printhead carried by a cartridge, wherein the printhead contains a plurality of orifices, the method comprising steps of:

defining the orifices to form a plurality of orifice groups;

providing a test graph, which comprises a plurality of test lines associated with the orifice groups;

obtaining a printing result of the test graph by ejecting ink from the orifices of the printhead;

selecting at least one of the orifice groups to be cleaned according to the printing result; and giving an order to perform a first cleaning action on said at least one of the orifice groups to be cleaned, and another order to perform a second cleaning action on the other orifice groups;

wherein the first cleaning action is selected from a group consisting of heating, ejecting, surface wiping, and surface adsorption, and electrical pulse for driving ink ejection of the first cleaning action is different from that of the second cleaning action.

26. A method of performing printhead maintenance, applied in an image-printing apparatus for cleaning a printhead carried by a cartridge, wherein the printhead contains a plurality of orifices, the method comprising steps of:

defining the orifices to form a plurality of orifice groups;

providing a test graph, which comprises a plurality of test lines associated with the orifice groups;

obtaining a printing result of the test graph by ejecting ink from the orifices of the printhead;

selecting at least one of the orifice groups to be cleaned according to the printing result; and giving an order to perform a first cleaning action on said at least one of the orifice groups to be cleaned, and another order to perform a second cleaning action on the other orifice groups;

wherein the first cleaning action is selected from a group consisting of heating, ejecting, surface wiping, and surface adsorption, and duration of ink ejection of the first cleaning action is different from that of the second cleaning action.

* * * * *